US005204235A

United States Patent [19]

Yamamoto et al.

[11] Patent Number: 5,204,235

[45] Date of Patent: Apr. 20, 1993

[54] METHOD FOR MANUFACTURING SILVER HALIDE EMULSION IN WHICH THE RIPENING TEMPERATURE IS LESS THAN THE NUCLEATION TEMPERATURE

[75] Inventors: Shin-ichi Yamamoto, Hachioji; Toshihiko Yagi, Shiroyama, both of Japan

[73] Assignee: Konica Corporation, Tokyo, Japan

[21] Appl. No.: 810,164

[22] Filed: Dec. 19, 1991

[30] Foreign Application Priority Data

Dec. 27, 1990 [JP] Japan ..... 2-408178

[51] Int. Cl.[5] ..... G03C 1/015

[52] U.S. Cl. ..... 430/569; 430/567

[58] Field of Search ..... 430/567, 569

[56] References Cited

U.S. PATENT DOCUMENTS

| | | | |
|---|---|---|---|
| 3,790,387 | 2/1974 | Musliner | 430/569 |
| 4,477,656 | 10/1984 | Himmelwright | 430/567 |
| 4,797,354 | 1/1989 | Saitou et al. | 430/567 |
| 4,798,775 | 1/1989 | Yagi et al. | 430/569 |
| 4,945,037 | 7/1990 | Saitou | 430/569 |

FOREIGN PATENT DOCUMENTS

| | | |
|---|---|---|
| 0165576 | 12/1985 | European Pat. Off. . |
| 0374853 | 6/1990 | European Pat. Off. . |
| 3707135 | 9/1987 | Fed. Rep. of Germany . |
| 3739470 | 6/1989 | Fed. Rep. of Germany . |

OTHER PUBLICATIONS

H. Bottcher et al., "Moderne Photographische Systeme," 2d Ed., Ch. 3.5.2, pp. 190–196, 1988, Deutscher Verlag fur Grundstoffindustrie, Leipzig, DD.

Patent Abstracts of Japan, vol. 3, No 3, No. 28 (E-96), Mar. 9, 1979.

European Search Report to Application No. EP 91 12 1983.

*Primary Examiner*—Charles L. Bowers, Jr.
*Assistant Examiner*—Mark F. Huff
*Attorney, Agent, or Firm*—Finnegan, Henderson, Farabow, Garrett & Dunner

[57] ABSTRACT

A method for manufacturing a silver halide emulsion. By the method, a silver halide emulsion comprising monodisperse silver halide grains having a high aspect ratio can be manufactured without use of low molecular weight gelatin. The method has the steps of forming nuclei of silver halide grains by adding a water-soluble silver salt and a water-soluble halide salt to a protective colloid solution, applying Ostwald ripening to the precipitation nuclei to form seed grains of silver halide at a temperature lower than the temperature at which the silver halide nuclei are formed, to form silver halide seed grains which mainly comprises twin grains having an average grain size of less than 0.25 μm and less than 50% of a surface area of each of the seed grains is occupied with {100} surface, growing the seed grains by adding a component to forming a silver halide to a liquid containing the seed grains.

23 Claims, No Drawings

METHOD FOR MANUFACTURING SILVER HALIDE EMULSION IN WHICH THE RIPENING TEMPERATURE IS LESS THAN THE NUCLEATION TEMPERATURE

FIELD OF THE INVENTION

This invention relates to a silver halide emulsion and a manufacturing method thereof. More specifically, this invention relates to a silver halide emulsion comprising small-grain-size monodispersed twin silver halide grains having high aspect ratio and a manufacturing method thereof.

BACKGROUND OF THE INVENTION

In the recent art of the silver halide photographic light-sensitive material (hereinafter referred simply to as light-sensitive material), techniques for a higher image quality and a lower silver consumption are progressing very fast. And for such purposes, there have been made various studies including monification of silver halide grains, enlargement of the aspect ratio of silver halide grains and use of monodispersed twin grains, from the viewpoint of the silver halide emulsion and manufacturing method thereof.

Techniques on silver halide grains having large aspect ratios are disclosed in Japanese Pat. O.P.I. Pub. Nos. 113926/1983, 113927/1983, 113928/1983 and 163046/1987. Silver halide grains disclosed therein are tabular grains having an aspect ratio larger than 8.

The term "aspect ratio" used here, which is applicable to a twin grain having two or more parallel twin faces, is given as a ratio of the diameter of converted circle to the space measured on a photograph thereof taken from a direction vertical to the twin face and the thickness between the two parallel surfaces of a grain.

One of the advantages of using silver halide grains having a large aspect ratio is that such grains have a per volume surface area larger than those of regular crystalline silver halide grains such as octahedrons, tetradecahedrons and cubes; accordingly, they can adsorb much sensitizing dyes on the surface, providing a higher sensitivity.

Minifying the grain size of silver halide cannot be dispensed with for a higher image quality and a lower silver consumption in light-sensitive materials. The grain size means the diameter of a circle converted in the same area from a projected image of a grain. The foregoing techniques can provide silver halide grains of high aspect ratios, but cannot make small and monodispersed silver halide grains.

Among patent applications published up to the present, ones disclosing a monodispersed twin grain emulsion include Japanese Pat O.P.I. Pub. Nos. 6643/1986 and 14636/1986. The technique described therein provides a monodispersed twin grain emulsion by carrying out Ostwald ripening after formation of nuclei to obtain an emulsion comprising fine monodispersed spherical seed grains and then growing the fine grains, hereinafter an emulsion comprising fine silver halide seed grains to be grown to suitable size grains is referred to a seed emulsion. The monodispersed twin grain emulsion prepared by this method has an advantage of being easily subjected to an optimum chemical sensitization, as compared with a multidispersed emulsion in which large grains and small grains are mixed with one another.

However, when such a seed emulsion is used, a highly monodispersed emulsion can be obtained, but an emulsion comprising small-size silver halide grains having high aspect ratio cannot be prepared.

In addition, a similar technique for making a monodispersed twin grain emulsion, which has an Ostwald ripening process after nucleus formation, is disclosed in Japanese Pat. O.P.I. Pub. Nos. 158426/1989, 213637/1989 and 838/1990. In this technique, a low molecular weight gelatin is used at the time of nucleus formation. However, the low molecular weight gelatin is insufficient in properties as a protective colloid and liable to aggregate silver halide grains, preventing stable manufacture of light-sensitive materials Further, it is more expensive than the relation ordinarily used in preparation of silver halide emulsions.

Japanese Pat O.P.I. Pub No. 28638/1990 discloses, in its Example 1, an emulsion containing small and high-aspect-ratio twin silver halide grains having an average grain size of 0.52 μm and an average aspect ratio of 9.5, which was obtained by forming nuclei at 30° C. and ripening them while raising the temperature to 65° C. But the emulsion's variation coefficient of grain size distribution is as high as 30%.

The present inventors made a follow-up study by carrying out Ostwald ripening at a temperature higher than that in the grain formation as disclosed therein. But, a monodispersed spheric twin seed emulsion as described in Japanese Pat. O.P.I. Pub. No. 6643/1986 could not be obtained, and grains in the seed emulsion were too large to give a desired monodispersed twin grain emulsion.

SUMMARY OF THE invention

Accordingly, a first object of the invention is to provide a monodispersed twin grain silver halide emulsion having small-size and high-aspect-ratio grains and a method for manufacturing such a monodispersed twin grain silver halide emulsion. A second objective of the invention is to provide a method for manufacturing a silver halide seed emulsion for the manufacture of said monodispersed twin grain emulsion using no low molecular weight gelation.

The above objects of the invention are achieved by a method for manufacturing a silver halide emulsion, comprising steps of forming nuclei of silver halide grains by adding a water-soluble silver salt and a water-soluble halide salt to a solution of protective colloid, applying Ostwald ripening to the precipitation nuclei at a temperature lower than the temperature at which the silver halide nuclei are formed, to form silver halide seed grains which mainly comprises twin grains having an average grain size of less than 0.25 μm, and less than 50% of a surface area of each of the seed grains is occupied with {100} surface, growing the seed grains by adding a component of silver halide to a liquid containing the seed grains.

DETAILED DESCRIPTION OF THE INVENTION

In the invention, "average grain size" is defined as grain size $d_i$, at which the product of frequency $n_i$ of grains having grain size $d_i$ and $d_i^3$ becomes the largest. (3 significant figures, the third figure is rounded to the nearest integer.)

The grain size can be determined, for example, by scattering grains on a flat sample stand, photographing them with an electron microscope at a magnification of 10,000 to 50,000, and measuring diameters or projected areas of the grains on the print. (The number of measured grains is not less than 1,000 selected at random.)

In the invention, the measuring method of grain size conforms to the above measuring method, and the average grain size is given by an arithmetic mean as follows:

$$\text{Average grain size} = \Sigma d_i n_i / \Sigma n_i$$

The average grain size of a silver halide seed emulsion of the invention is desirably 0.01 to 0.25 μm, more desirably 0.03 to 0.20 μm, and most desirably 0.05 to 0.15 μm.

The silver halide seed emulsion of the invention preferably comprises silver bromide grains which may contain silver iodide or silver chloride within limits not hurtful to the effect of the invention.

The term "twin" used here means a silver halide crystal having at least one twin face in a grain; the classification of twin crystals is described in detail in the reports by Klein and Moiser on page 99 of Photographische Korespondenz, Vol.99 and on page 57, Vol. 100 of the same.

Two or more twin faces in the twin may be parallel or not parallel to each other. Further, the surface of the twin may be comprised of {111} faces or {100} faces, or may be comprised of both the kinds of faces.

The term "twin grain having {100} faces at a percentage of less than 50%" used in the invention means that when the percentage of {100} faces is less than 50 % of the grain surface, the remaining surface may have any of other faces including {111} as well as rounded cubes and tetradecahedrons. The percentage of {100} surface can be determined by the method described in "Determination of Crystal Habit of Fine Silver Halide Grains in Photographic Emulsion through their Adsorption of Dyes", Journal of Chemical Society of Japan 6 p. 942–946, 1984.

The term "spherical twin grain" means that when an electron-microscopic photograph of a silver halide grain is observed, the crystal's edge at which faces such as {111} faces or {100} faces are in contact with each other is rounded, and that when three-dimentional axes orthogonal to one another are set at a point near the gravity center of a grain, and when an axial segment is cut out by the grain surfaces facing each other in each of lengthwise, transverse and vertical directions, the ratio of the longest axial segment's length L to the shortest axial segment's length 1 (C=L/1) is 1.0 to 2.0 and preferably 1.0 to 1.5. It is particularly preferred for the grain to be rounded to the extent that {111} faces or {100} faces cannot be recognized In the invention, "comprised mainly of twin grains or spherical twin grains each having {100} surface at a percentage of less than 50%" means that the ratio of such twin grains is 60% or more, preferably 80% or more, and especially 95 to 100% of the total grains by number.

Preferably, the twin grains have a size distribution of monodispersion. This means that the variation coefficient of grain size (grain size standard deviation/average grain size×100) is less than 25%, preferably not more than 20% and especially not more than 15%.

Next, the manufacturing methods of a silver halide seed emulsion of the invention (hereinafter simply referred to as seed emulsion of the invention) and a silver halide emulsion are described.

The seed emulsion of the invention is prepared by a method for manufacturing a silver halide seed emulsion comprised mainly of twin grains, which has (a) a nucleus forming process and (b) an Ostwald ripening process and is characterized in that said Ostwald ripening process is carried out at a temperature lower than the average temperature in said nucleus forming process. Further, the silver halide emulsion of the invention is prepared by a method for manufacturing a silver halide emulsion comprised mainly of twin grains, which has (a) a nucleus forming process, (b) an Ostwald ripening process and (c) a growing process and is characterized in that the, Ostwald ripening process is carried out at a temperature lower than the average temperature in the nucleus forming process.

In the invention, the nucleus forming process is a process to add a water-soluble silver salt and a water-soluble halide salt to a protective colloid solution to form silver halide nuclei and a process until the number of silver halide nuclei becomes the largest.

The Ostwald ripening process is a process to decrease the number of silver halide nuclei or silver halide crystals through ripening.

In the method for manufacturing a seed emulsion of the invention, the temperature during the nucleus formation is preferably not lower than 40° C., more preferably 40° to 50° C. and especially 40° to 45° C. The pBr during the nucleus formation is preferably 0.1 to 2.5, more preferably 0.6 to 2.0 and especially 1.1 to 1.5. The pAg during the nucleus formation is preferably 0.1 to 2.5, and more preferably 1.1 to 1.5. Other preferable conditions in the nucleus forming process are:

(1) The gelatin concentration is 0.1 to 10 wt%, more preferably 0.5 to 5 wt%.
(2) The silver halide composition of nuclei is silver bromide or silver iodobromide each having a silver iodide content of zero to 10 mol%, more preferably zero to 5 mol %.
(3) The pH is 2.0 to 12.0, more preferably 3.0 to 8.0.
(4) Addition rate of a water-soluble silver salt is $1.0\times10^{-3}$ to 3.0 mol/min, preferably $3.0\times10^{-3}$ to $5.0\times10^{-1}$ mol/min per liter of mother liquid and especially $5.0\times10^{-3}$ to $1.0\times10^{-1}$ mol/ min per liter of mother liquid.

The Ostwald ripening process is carried out at a temperature lower than the average temperature of the nucleus forming process. The temperature difference between the nucleus forming process and the Ostwald ripening process is preferably 10° to 50° C., more preferably 15° to 40° C. and especially 15° to 25° C.

Other preferable conditions during Ostwald ripening are:

(1) The silver halide solvent content is $10^{-5}$ to 2.0 mol/mol silver halide.
(2) The temperature is 5° to 39° C., more preferably 10° to 30° C.
(3) The pH is 2 to 13, more preferably 3 to 12.
(4) The gelatin concentration is 0.1 to 10 wt %, more preferably 0.5 to 5 wt %.
(5) The pBr is 0.5 to 2.9, more preferably 1.3 to 1.9.

The silver halide solvent used in the seed grain forming process of the invention includes (a) organic thioethers described in U.S. Pat. Nos. 3,271,157, 3,531,289, 3,574,628, Japanese Pat. O.P.I. Pub. Nos. 1019/1979, 158917/1979 and Japanese Pat. Exam. Pub. No. 30571/1983, (b) thiourea derivatives described in Japanese Pat. O.P.I. Pub. Nos. 82408/1978, 29829/1980 and 77736/1982, (c) silver halide solvents having a thiocarbonyl group placed between an oxygen or sulfur atom and a nitrogen atom described in Japanese Pat. O.P.I. Pub. No. 144319/1978, (d) imidazoles described in Japanese Pat. O.P.I. Pub. No. 100717/1979, (e) sulfites, (f) thiocyanates, (g) ammonia, (h) hydroxyalkyl-substituted ethylenediamines described in Japanese Pat. O.P.I. Pub. No. 196228/1982, (i) substituted mercaptotetrazoles described in Japanese Pat. O.P.I. Pub. No. 202531/1982, (j) water-soluble bromides and (k) benzimidazole derivatives described in Japanese Pat. O.P.I. Pub. No. 54333/1983.

Typical examples of the silver halide solvents are illustrated below, according to the above classification (a) to (k).

(a)

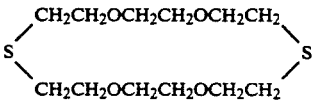

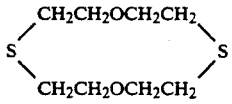

$HOCH_2CH_2SCH_2CH_2SCH_2CH_2OH$ $CH_2NHCOCH_2CH_2COOH$
|
$CH_2SCH_2CH_2SC_2H_5$ $CH_2NHCOC_3H_7$
|
$CH_2SCH_2CH_2SCH_2CH_2COOH$

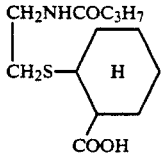

(b)

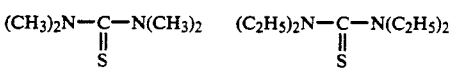

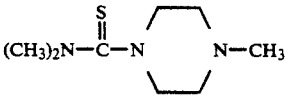

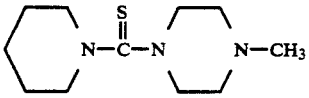

(c)

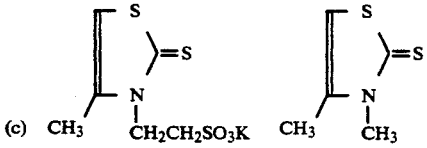

(d)

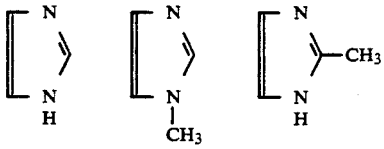

-continued

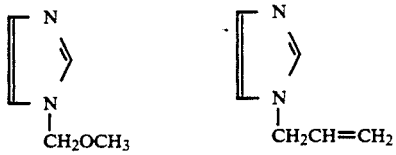

(e) $K_2SO_3$, $Ka_2SO_3$
(f) $NH_4SCN$, KSCN
(g) $NH_3$
(h) $(HOCH_2CH_2)_2NCH_2CH_2N(CH_2CH_2OH)_2$ $(CH_3\underset{\underset{OH}{|}}{C}HCH_2)_2NCH_2CH_2N(CH_2\underset{\underset{OH}{|}}{C}HCH_3)_2$ $(C_2H_5)_2NCH_2CH_2N(CH_2CH_2OH)_2$ $(C_2H_5\underset{\underset{OH}{|}}{C}HCH_2)_2NCH_2CH_2N(CH_2\underset{\underset{OH}{|}}{C}HC_2H_5)_2$ (i)

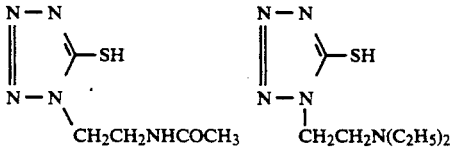

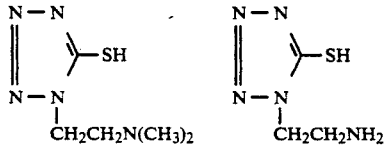

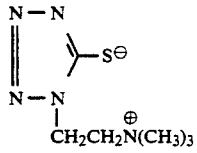

(j) NaBr, $NH_4Br$, KBr (k)

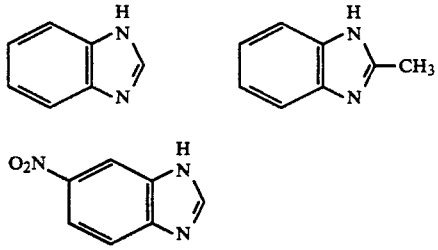

These solvents may be used n combination of two or more types. Of them, preferable solvents are thioethers, thiocyanates, thoureas, ammonia and bromides, and a combination of a bromide with ammonia is particularly preferred.

One preferable embodiment of the invention, which carries out ripening for 30 sec to 10 min under conditions of pH 10.8 to 12.0 and temperature 15° to 25° using a solvent combinated 0.4 to 1.0 mol/1 of ammonia with 0.03 to 0.5 mol/1 of potassium bromide, provides an emulsion containing favorable seed grains.

In order to control the ripening, a water-soluble silver salt may be added in the seed grain forming process of the invention.

The seed emulsion of the invention can be grown in the growing process to obtain an emulsion suitable for practical use in a light-sensitive material.

The growing process is a process to feed components necessary to grow silver halide crystals at a rate of lower than the critical growth rate which begins to generate new nuclei, and this process is virtually devoid of formation of new nuclei and Ostwald ripening.

In the growing process of the invention, the growth condition may be any of the acid process, neutral process and ammonia process. And there may be used conventional methods described, for example, in Japanese Pat. O.P.I. Pub. Nos. 6643/1986, 14630/1986, 112142/1986, 157024/1987, 18556/1987, 92942/1988, 151618/1988, 161351/1988, 220238/1988 and 311244/1988.

It is preferable that the supply components to grow crystals be fed at a rate of 20 to 100% of the critical growth rate which begins to generate new nuclei. The supply component may be either a combination of a water-soluble silver salt and a halide solution or that of a water-soluble silver salt and fine silver halide grains.

Further, a conventional flocculation method or noodle washing method can be used in order to remove by-products, excessive salts or other useless components.

The average silver iodide content of silver halide grains prepared from the seed emulsion of the invention is preferably 0.1 to 45 mol%, more preferably 0.5 to 25 mol% and especially 1 to 20 mol%.

A silver halide emulsion prepared by the manufacturing method of the invention may be of silver iodobromode or silver iodochlorobromoide, and may be a surface latent image type or an internal latent image type.

A silver halide emulsion prepared by the manufacturing method of the invention can be chemically sensitized according to a conventional method. Further, it can be spectrally sensitized to a desired wavelength region with a dye known as a sensitizing dye in the art. Such a sensitizing dye may be employed singly or in combination.

A silver halide emulsion prepared by the manufacturing method of the invention may contain an antifoggant and a stabilizer.

A silver halide emulsion prepared by the manufacturing method of the invention, and a light-sensitive material to which said emulsion is applied, may contain conventional additives.

Useful photographic additives are described in Research Disclosure Nos. 17643, 18716 and 308119 (hereinafter referred to as RD17643, RD18716 and RD308119, respectively).

Conventional photographic additives, usable in a silver halide emulsion prepared by the manufacturing method of the invention and a light-sensitive material to which said emulsion is applied, are also described in the above Research Disclosure.

A silver halide emulsion prepared by the manufacturing method of the invention and a light-sensitive material to which said emulsion is applied may employ various couplers; typical examples thereof are described in the above Research Disclosure.

The additives used in a silver halide emulsion prepared by the manufacturing method of the invention, and in a light-sensitive material to which said emulsion is applied, may be incorporated therein by a dispersing method described in RD308119, XIV.

In a silver halide emulsion prepared by the manufacturing method of the invention and a light-sensitive material to which said emulsion is applied, there may be employed the supports described in RD17643, p. 28; RD18716, pp. 647-8; and RD308119, XIX.

In a light-sensitive material prepared by use of a silver halide emulsion according to the manufacturing method of the invention, there may be provided auxiliary layers such as filter layer and intermediate layer described in RD308119, VII, Sec. K.

A light-sensitive material prepared by use of a silver halide emulsion according to the manufacturing method of the invention may have various layer configurations such as described in RD308119, VII, Sec. K.

Usable materials as the support include polyethylene laminated paper, polyethylene terephthalate film, baryta paper and cellulose triacetate film.

The invention can be applied to a variety of color light-sensitive materials represented by color negative film for movies or general purposes, color reversal film for slides or TV, color paper, color positive film and color reversal paper.

In obtaining color images on a light-sensitive material which uses a silver halide emulsion according to the manufacturing method of the invention, color development may be made in a conventional manner after exposure. Such color development can be performed according a method described in RD17643, pp. 28-29; RD18716, p. 647; or RD308119, XIX.

EXAMPLE

Example 1 (comparison)

Preparation of comparative seed emulsion

A seed emulsion comprised of silver bromide was prepared by use of the following solutions

| | |
|---|---|
| [$A_1$] | |
| Ossein gelatin | 40 g |
| Potassium bromide | 23.7 g |
| Water to make | 4000 ml |
| [$B_1$] | |
| Silver nitrate | 600 g |
| Water to make | 803 ml |
| [$C_1$] | |
| Ossein gelatin | 16.1 g |
| Potassium bromide | 420 g |
| Water to make | 803 ml |
| [$D_1$] | |
| Aqueous ammonia (28%) | 235 ml |

To feed these solutions, an apparatus disclosed in Japanese Pat. O.P.I. Pub. No. 160128/1987 was used, and the feed nozzle toward the lower portion of the stirring propeller was set to be six nozzles each for solutions $B_1$ and $C_1$.

While stirring solution $A_1$ at 430 rpm and 40° C., solutions $B_1$ and $C_1$ were added thereto at a flow rate of 62.8 ml/min by the double-jet method.

Four minutes and 46 seconds after start of the addition, the flow rate was gradually raised so as to reach the final flow rate of 105 ml/min at the end of the total addition time of 10 minutes and 45 seconds. During the addition, the pBr was maintained at 1.3 with potassium bromide. Thirty minutes after completion of the addition, the liquor temperature was raised to 60° C. and the stirring rate to 460 rpm, then solution $D_1$ was added thereto in 1 minute, followed by Ostwald ripening for 5 minutes.

During the Ostwald ripening, the KBr concentration was 0.028 mol/1, the ammonia concentration 0.63 mol/1 and the pH 11.7.

Upon termination of the ripening period, the reaction liquor was neutralized to pH 5.7 with acetic acid to stop the ripening, and then desalted and washed by a conventional method.

According to electron-microscopic observation, the resultant seed emulsion was comprised of spherical grains having an average grain size of 0.44 μm and a grain size distribution variation coefficient of 19%.

Growth of gains of the seed emulsion

Subsequently, the grains of the seed emulsion were grown using by the following procedure to prepare, a silver halide emulsion.

| | |
|---|---|
| [$A_2$] | |
| Ossein gelatin | 37 g |
| Disodium propyleneoxy-polyoxyethylene disuccinate (10% methanol solution) | 10 ml |
| Seed emulsion | an amount equivalent to 0.191 mol of silver halide |
| Water to make | 4000 ml |
| [$B_2$] | |
| Ossein gelatin | 109 g |
| Potassium bromide | 804 g |
| Potassium iodide | 23.1 g |
| Water to make | 4628 ml |
| [$C_2$] | |
| Silver nitrate | 1168 g |
| Water to make | 6248 ml |

While stirring solution $A_2$ vigorously at 65° C., solutions $B_2$ and $C_2$ were added thereto over a period of 112 minutes by the double-jet method. During the addition, the pH was maintained at 2.0 with nitric acid and the pAg at 9.0. The addition rate of solutions $B_2$ and $C_2$ was linearly increased to give a final addition rate of 6.4 times as large as the initial addition rate.

After the addition, the pH was adjusted to 6.0 and then flocculation desalting was performed to remove excessive salts with an aqueous solution of Demol (product of Kao Atlas)and an aqueous solution of magnesium sulfate, so that an emulsion having a pAg 8.5 and pH of 5.85 at 40° C. was obtained.

Electron-microscopic observation of the emulsion gave the results of average grain size, 1.2 μm; grain size distribution variation coefficient, 21%; average thickness, 0.46 μm; percentage of tabular grains having an aspect ratio larger than 2, 86%; and average aspect ratio of grains having an aspect ratio larger than 2, 2.6.

Example 2 (present invention)

Preparation of seed emulsion of the invention

A seed emulsion of the invention was prepared by the same method as in Example 1 except that the average temperature in the Ostwald ripening was 20° C.

During the ripening, the KBr concentration was 0.026 mol/1, the ammonia concentration 0.63 mol/1, and the pH 11.6.

Electron-microscopic observation proved this seed emulsion was comprised of spherical grains having an average grain size of 0.20 μm and a grain size distribution variation coefficient of 18%.

Growth of grains of the seed emulsion

Subsequently, the seed emulsion was grown to a silver halide emulsion comprised of tabular twins in a similar manner as in Example 1 and then subjected to desalting. The resultant emulsion had a pAg of 8.5 and pH of 5.84 at 40° C.

Electron-microscopic observation of the emulsion gave the results of average grain size, 1.7 μm; grain size distribution variation coefficient, 19%; average thickness, 0.23 μm; percentage of tabular grains having an aspect ratio larger than 2, 85%; and average aspect ratio of grains having an aspect ratio larger than 2, 7.4.

Example 3 (comparison)

Preparation of comparative seed emulsion

A comparative seed emulsion was prepared in the same manner as in Example 1 except that the average temperature in the Ostwald ripening was the same as that in the nucleus forming process, 40° C.

During the ripening, the KBr concentration was 0.027 mol/1, the concentration of ammonia 0.63 mol/1, and the pH 11.6.

Electron-microscopic observation showed that the seed emulsion prepared was comprised of spherical grains having an average grain size of 0.32 μm and a grain size distribution variation coefficient of 17%.

Growth of grains of the seed emulsion

Subsequently, the seed emulsion was grown in the same manner as in Example 1. The obtained was a tabular twin silver halide emulsion, which was then subjected to desalting to give an emulsion having a pAg 8.5 and a pH of 5.85 at 40° C.

The results of electron-microscopic observation of this emulsion were: average grain size, 1.4 μm; grain size distribution variation coefficient, 19%; average thickness, 0.35 μm; percentage of tabular grains having an aspect ratio larger than 2, 84%; and average aspect ratio of grains having an aspect ratio larger than 2, 4.0.

Example 4 (present invention)

Preparation of seed emulsion of the invention

A seed emulsion of the invention was prepared in the same manner as in Example 1 except that the average temperature in the Ostwald ripening was 15° C.

During the ripening, the KBr concentration was 0.026 mol/1, the ammonia concentration 0.63 mol/1, and the pH 11.7.

Electron-microscopic observation showed that the seed emulsion was comprised of spherical grains having an average grain size of 0.19 μm and a grain size distribution variation coefficient of 20%.

Growth of grains of the seed emulsion

Subsequently, the seed emulsion was grown in a similar manner as in Example 1 to prepare a tabular twin silver halide emulsion. After desalting thereof, an emulsion having a pAg of 8.5 and a pH of 5.84 at 40° C. was obtained.

The results of electron-microscopic observation of this emulsion were: average grain size, 1.8 μm; grain size distribution variation coefficient, 18%; average thickness, 0.21 μm; percentage of tabular grains having an aspect ratio larger than 2, 89%, and average aspect ratio of grains having an aspect ratio larger than 2, 8.6.

Example 5 (comparison)

Preparation of seed emulsion

A comparative seed emulsion was prepared in the same manner as in Example 1, except that the average temperature in the nucleus forming process was 20° C. and that in the Ostwald ripening 60° C.

During the ripening, the KBr concentration was 0.028 mol/1, the concentration of ammonia 0.62 mol/1, and the pH 11.5.

Electron-microscopic observation, showed that the seed emulsion was comprised of spherical grains having an average grain size of 0.40 μm and a grain size distribution variation coefficient of 19%.

Growth of grains of the seed emulsion

Subsequently, the seed was grown to a tabular twin silver halide emulsion in a similar manner as in Example 1. After desalting it, an emulsion having a pAg of 8.5 and at pH of 5.86 at 40° C. was obtained.

Electron-micropscopic observation of this emulsion gave the results of average grain size, 1.3 μm; grain size distribution variation coefficient, 21%; average thickness, 0.42 μm; percentage of tabular grains having an aspect ratio larger than 2, 87%; and average aspect ratio of grains having an aspect ratio larger than 2, 3.1.

Example 6 (present invention)

Preparation of seed emulsion of the invention

A seed emulsion of the invention was prepared in the same manner as in Example 1, except that the average temperature in the nucleus forming process was 50° C. and that in the Ostwald ripening 20° C.

During the ripening, the KBr concentration was 0.026 mol/1, the ammonia concentration 0.63 mol/1, and the pH 11.6.

According to electron-microscopic observation, the seed emulsion proved was comprised of spherical grains having an average grain size of 0.22 μm and a grain size distribution variation coefficient of 19%.

Growth of grains of the seed emulsion

Subsequently, the seed emulsion was grown to a tabular twin silver halide emulsion in a similar manner as in Example 1. Desalting of it gave an emulsion having a pAg of 8.5 and a pH of 5.85 at 40° C.

The results of electron-microscopic observation of the emulsion were: average grain size, 1.7 μm; grain size distribution variation coefficient, 18%; average thickness, 0.23 μm; percentage of tabular grains having an aspect ratio larger than 2, 89%; and average aspect ratio of grains having an aspect ratio larger than 2, 7.4.

Example 7 (present invention)

Preparation of seed emulsion of the invention

A seed emulsion of the invention was prepared in the same manner as in Example 1, except that the average temperature in the nucleus forming process was 60° C. and that in the Ostwald ripening 20° C.

During the ripening, the KBr concentration was 0.025 mol/1, the ammonia concentration 0.63 mol/1, and the pH 11.7.

Electron-microscopic observation showed that the seed emulsion was comprised of spherical grains having an average grain size of 0.24 μm and a grain size distribution variation coefficient of 20%.

Growth of grains of the seed emulsion

Subsequently, the seed emulsion was grown to a tabular twin silver halide emulsion in a similar manner as in Example 1. Desalting of it gave an emulsion having a pAg 8.5 and a pH of 5.85 at 40° C.

The results of electron-microscopic observation of the emulsion were: average grain size, 1.7 μm; grain size distribution variation coefficient, 19%; average thickness, 0.25 μm; percentage of tabular grains having an aspect ratio larger than 2, 89%; and average aspect ratio of grains having an aspect ratio larger than 2, 6.8.

Example 8 (comparison)

Preparation of comparative seed emulsion

A comparative seed emulsion was prepared in the same manner as in Example 1, except that the average temperature in the nucleus forming process was 60° C. and that in the Ostwald ripening 70° C.

During the ripening, the KBr concentration was 0.026 mol/1, the ammonia concentration 0.63 mol/1, and the pH 11.7.

Electron-microscopic observation showed that the seed emulsion was comprised of spherical grains having an average grain size of 0.48 μm and a grain size distribution variation coefficient of 21%.

Growth of grains of the seed emulsion

Subsequently, the seed emulsion was grown to a tabular twin silver halide emulsion in a similar manner as in Example 1. Desalting of it gave an emulsion having a pAg 8.5 and a pH of 5.85 at 40° C.

Electron-microscopic observation of the emulsion gave the results of average grain size, 1.2 μm; grain size distribution variation coefficient, 21%; average thickness, 0.49 μm; and average aspect ratio, 2.4.

Example 9 (present invention)

The seed emulsion of the invention in Example 4 was grown to a tabular twin silver halide emulsion in a similar manner as in Example 1 by use of the following three solutions.

| | |
|---|---|
| [$A_2$] | |
| Ossein gelatin | 37 g |
| Disodium propyleneoxy-polyethyleneoxy disuccinate (10% methanol solution) | 10 ml |
| Seed emulsion | an amount equivalent to 0.191 mol of silver halide |
| Water to make | 4000 ml |
| [$B_2$] | |
| Ossein gelatin | 25.1 g |
| Potassium bromide | 184.9 g |
| Potassium iodide | 5.31 g |
| Water to make | 1064 ml |
| [$C_2$] | |
| Silver nitrate | 269 g |
| Water to make | 1437 ml |

After desalting, an emulsion having a pAg 8.5 and a pH of 5.84 at 40° C. was obtained.

The results of electron-microscopic observation of the emulsion were: average grain size, 0.9 μm; grain size distribution variation coefficient, 18%; average thickness, 0.20 μm; percentage of tabular grains having an aspect ratio larger than 2, 87%; and average aspect ratio of grains having an aspect ratio larger than 2, 4.5.

Example 10

Preparation of seed emulsion of the invention

A seed emulsion of the invention was prepared in the same manner as in Example 2 except that solution $D_2$ was added for 10 minutes and stirring speed during Ostwald ripening was 5000 r.p.m.. Potassium bromide concentration, ammonia concentration and pH value were maintained at 0.025 mol/1, 0.63 mol/1 and 11.7, respectively, during the Ostwald ripening of the seed emulsion. It was observed by an electron microscope that the seed emulsion was comprised of tetradecahedron silver halide grains having an average grains size of 0.20 μm and a grains size distribution variation coefficient of 23%. A ratio of [100]surface on the grain surface was 45%.

Growth of grains of the seed emulsion

The grains of the seed emulsion were grown in the same manner as in Example 1 to prepare a silver halide emulsion comprising tabular twin grains. After desalting, values of pAg and pH of the obtained emulsion were 8.5 and 5.86, respectively, at 40° C. By electron-microscopic observation, grains of thus obtained emulsion had an average grain size of 1.7 μm, a grain size distribution variation coefficient of 23%, an average thickness of 0.23 μm, and a ratio of grains having an aspect ratio of 2 or more was 84 %, and an average aspect ratio of the grains having an aspect ratio of 2 or more was 7.4.

Example 11

Preparation of seed emulsion of the invention

A seed emulsion of the invention was prepared in the same manner as in Example 2 except that solution $D_2$ was added for 5 minutes and stirring speed during Ostwald ripening was 600 r.p.m.. Potassium bromide concentration, ammonia concentration and pH value were maintained at 0.026 mol/1, 0.63 mol/1 and 11.7, respectively, during the Ostwald ripening of the seed emulsion. It was observed by an electron microscope that the seed emulsion was comprised of tetradecahedron silver halide grains having an average grains size of 0.20 μm and a grains size distribution variation coefficient of 29%. A ratio of [100] surface on the grain surface was 45%.

Growth of grains of the seed emulsion

The grains of the seed emulsion were grown in the same manner as in Example 1 to prepare a silver halide emulsion comprising tabular twin grains. After desalting, values of pAg and pH of the obtained emulsion were 8.5 and 5.86, respectively, at 40° C. By electron-microscopic observation, grains of thus obtained emulsion had an average grain size of 1.7 μm, a grain size distribution variation coefficient of 34%, an average thickness of 0.23 μm, and a ratio of grains having an aspect ratio of 2 or more was 86 %, and an average aspect ratio of the grains having an aspect ratio of 2 or more was 7.4.

In the above Examples, any of the silver halide seed emulsions and silver halide emulsions prepared by the method of the invention did not cause aggregation.

The grain characteristics obtained in Examples 1 to 11 are shown in Table 1.

TABLE 1

| | Conditions for seed emulsion preparation | | Seed emulsion | | Silver halide emulsion obtained from the seed emulsion | | | |
|---|---|---|---|---|---|---|---|---|
| Example | Nucleus forming process av. temp. (°C.) | Ostwald ripening process av. temp. (°C.) | Average grain size (μm) | Grain size distribution variation coefficient (%) | Average grain size (μ) | Grain size distribution variation coefficient (%) | Average thickness (μm) | Average aspect ratio |
| 1 (Comparison) | 40 | 60 | 0.44 | 19 | 1.2 | 21 | 0.46 | 2.6 |
| 2 (Comparison) | 40 | 20 | 0.20 | 18 | 1.7 | 19 | 0.23 | 7.4 |
| 3 (Comparison) | 40 | 40 | 0.32 | 17 | 1.4 | 19 | 0.35 | 4.0 |
| 4 (Invention) | 40 | 15 | 0.19 | 20 | 1.8 | 18 | 0.21 | 8.6 |
| 5 (Invention) | 20 | 60 | 0.04 | 19 | 1.3 | 21 | 0.42 | 3.1 |
| 6 (Invention) | 50 | 20 | 0.22 | 19 | 1.7 | 18 | 0.23 | 7.4 |
| 7 (Invention) | 60 | 20 | 0.24 | 20 | 1.7 | 19 | 0.25 | 6.8 |
| 8 (Invention) | 60 | 70 | 0.48 | 21 | 1.2 | 21 | 0.49 | 2.4 |
| 9 (Invention) | Seed emulsion of Example 4 | | | | 0.9 | 18 | 0.20 | 4.5 |
| 10 (Invention) | 40 | 20 | 0.20 | 23 | 1.7 | 23 | 0.23 | 7.4 |
| 11 (Comparison) | 40 | 20 | 0.20 | 29 | 1.7 | 34 | 0.23 | 7.4 |

What is claimed is:

1. A method for manufacturing a silver halide emulsion, which mainly comprises twin silver halide grains, comprising steps of forming a precipitation nuclei of silver halide grains by adding a water-soluble silver slat and a water soluble halide salt to a protective colloid solution, applying Ostwald ripening to aid precipitation nuclei aty a temperature lower than the temperature at which said silver halide nuclei are formed in the presence of a bromide and ammonia, to form silver halide seed grains which mainly comprises twin grains having an average grain size of less than 0.25 μm, and less than 50% of a surface area of each of said seed grains is occupied with {100} surface, and growing said seed grains by adding a component of silver halide to a liquid containing said seed grains.

2. The method of claim 1, wherein said seed rains have an average grain size of from 0.01 μm to 0.25 μm.

3. The method of claim 2, wherein said seed grains have an average grain size of from 0.05 μm to 0.15 μm.

4. The method of claim 1, wherein said seed grains have a monodisperse size distribution having a variation coefficient of not more than 20%.

5. The method of claim 1, wherein said nuclei forming step is performed at a temperature of not lower than 40° C.

6. The method of claim 5, wherein said nuclei forming step is performed at a temperature of from 40° C. to 50° C.

7. The method of claim 6, wherein said nuclei forming step is performed at a temperature of from 40° C. to 45° C.

8. The method of claim 1, wherein said nuclei forming step is performed under a condition of pAg of 0.1 to 2.5.

9. The method of claim 8, wherein said nuclei forming step is performed under a condition of pAg of 1.1 to 1.5

10. The method of claim 1, wherein said water-soluble silver salt is added to said protective colloid solution at a rate of $1.0\times10^{-3}$ mol/min to 3.0 mol/min per liter of said protective colloid solution.

11. The method of claim 10, wherein said water-soluble silver salt is added to said protective colloid solution at a rate of $5.0\times10^{-3}$ mol/min to $1.0\times10^{-1}$ mol/min per liter of said protective colloid solution.

12. The method of claim 1, wherein said nuclei comprise silver bromide or silver iodobromide.

13. The method of claim 12, wherein said nuclei comprise silver iodobromide containing not more than 5 mol% of silver iodide.

14. The method of claim 1, wherein the temperature at which said Ostwald ripening is performed, is 10° C. to 50° C. lower than the temperature at which said nuclei are formed.

15. The method of claim 14, wherein the temperature at which said Ostwald ripening is performed, is lower 15° C. to 25° C. than the temperature at which said nuclei are formed.

16. The method of claim 1, wherein said Ostwald ripening is performed in the presence of a silver halide solvent in an amount of $10^{-5}$ mol per mol of silver halide.

17. The method of claim 1, wherein said Ostwald ripening is performed at a temperature of from 5° C. to 39° C.

18. The method of claim 17, wherein said Ostwald ripening is performed at a temperature of from 10° C. to 30° C.

19. The method of claim 1, wherein said Ostwald ripening is performed under a condition of pBr of from 0.5 to 2.9.

20. The method of claim 19, wherein said Ostwald ripening is performed under a condition of pBr of from 1.3 to 1.9.

21. The method of claim 20, wherein silver halide grains formed by growing said seed grains comprise silver iodobromide or silver iodochlorobromide.

22. The method of claim 21, wherein said grains have an average silver iodide content of from 0.1 to 45 mol%.

23. The method of claim 21, wherein said grains have an average silver iodide content of from 1 to 20 mol%.

* * * * *

UNITED STATES PATENT AND TRADEMARK OFFICE

CERTIFICATE OF CORRECTION

PATENT NO. : 5,204,235

DATED : April 20, 1993

INVENTOR(S) : Shin-ichi Yamamoto et al.

It is certified that error appears in the above-indentified patent and that said Letters Patent is hereby corrected as shown below:

Claim 1, column 14, line 44, change "slat" to --salt--.

Claim 1, column 14, line 47, change "aty" to --at--.

Claim 2, column 14, line 56, change "rains" to --grains--.

Signed and Sealed this

Fifteenth Day of March, 1994

*Attest:*

*Attesting Officer*

Bruce Lehman

BRUCE LEHMAN

*Commissioner of Patents and Trademarks*